US009663970B1

(12) United States Patent
Yang

(10) Patent No.: US 9,663,970 B1
(45) Date of Patent: May 30, 2017

(54) TSA LOCK WITH MULTIPLE DIAL COMBINATIONS

(71) Applicant: Yao-Kun Yang, Changhua County (TW)

(72) Inventor: Yao-Kun Yang, Changhua County (TW)

( * ) Notice: Subject to any disclaimer, the term of this patent is extended or adjusted under 35 U.S.C. 154(b) by 0 days.

(21) Appl. No.: 15/402,236

(22) Filed: Jan. 10, 2017

(51) Int. Cl.
*E05B 37/02* (2006.01)
*E05B 35/10* (2006.01)
*E05B 37/00* (2006.01)

(52) U.S. Cl.
CPC ..... *E05B 35/105* (2013.01); *E05B 37/0034* (2013.01); *E05B 37/025* (2013.01); *E05B 37/0031* (2013.01); *E05B 37/0058* (2013.01); *Y10T 70/415* (2015.04)

(58) Field of Classification Search
CPC .. E05B 35/105; E05B 37/025; E05B 37/0034; E05B 37/0031; E05B 37/0041; E05B 37/0058; Y10T 70/415; Y10T 70/424; Y10T 70/461; Y10T 70/7141; Y10T 70/7147
USPC .... 70/21, 22, 25, 26, 38 A, 38 B, 38 C, 284, 70/285, DIG. 63, DIG. 71
See application file for complete search history.

(56) References Cited

U.S. PATENT DOCUMENTS 7,779,657 B2 * 8/2010 Yu ..... E05B 35/105 70/21
2005/0039500 A1 * 2/2005 Yu ..... E05B 35/105 70/25
2005/0262902 A1 * 12/2005 Ling ..... E05B 37/0034 70/21
2006/0218981 A1 * 10/2006 Yu ..... E05B 35/105 70/21
2006/0266084 A1 * 11/2006 Kuo ..... E05B 35/105 70/21
2007/0227202 A1 * 10/2007 Yen ..... E05B 35/105 70/21
2007/0289343 A1 * 12/2007 Yu ..... E05B 35/105 70/21
2008/0120999 A1 * 5/2008 Lee ..... E05B 37/0034 70/21
2008/0156046 A1 * 7/2008 Yu ..... E05B 35/105 70/21
2009/0031764 A1 * 2/2009 Huang ..... E05B 35/105 70/21
2012/0279264 A1 * 11/2012 Yu ..... E05B 37/025 70/21

(Continued)

*Primary Examiner* — Lloyd Gall

(57) ABSTRACT

A lock includes a core, a driving member, a rotary member, a push member and a dial unit. When a TSA key is used to rotate the core clockwise, the rotary member contacts the driving member until the inclined face of the rotary member contact the push member which is pushed by a first spring toward the rotary member so that the shackle is removed from the reception hole of the push member to unlock the lock. When a correct key is used to rotate the core counter clockwise, the rotary member is rotated counter clockwise to engaging member of the rotary member is engaged with the slide slot. The driving member is pushed upward by the resilient member to contact the rotary member. The block of the driving member is removed from the recessed area of the pawl member to allow the user to set the correct combinations.

8 Claims, 10 Drawing Sheets

(56) References Cited

U.S. PATENT DOCUMENTS

| | | | | |
|---|---|---|---|---|
| 2012/0304711 | A1* | 12/2012 | Misner | E05B 35/105 70/21 |
| 2013/0055774 | A1* | 3/2013 | Yang | E05B 37/025 70/307 |
| 2014/0338407 | A1* | 11/2014 | Zhang | E05B 37/0068 70/21 |
| 2014/0352370 | A1* | 12/2014 | Huang | E05B 37/0034 70/21 |
| 2014/0373579 | A1* | 12/2014 | Lai | E05B 67/06 70/21 |

* cited by examiner

TSA LOCK WITH MULTIPLE DIAL COMBINATIONS

BACKGROUND OF THE INVENTION

1. Fields of the Invention

The present invention relates to a transportation security administration lock (TSA lock), and more particularly, to a TSA lock with three dial combinations, and the initial combination can be retrieved by the users by using the correct key.

2. Descriptions of Related Art

The conventional baggage locks can be usually unlocked by using a correct key or setting correct combinations. Nevertheless, for inspection purposes, the transportation security administration may want to inspect the travelers' luggage when necessary, in most cases, the owners are not at the site when the transportation security administration opens the luggage. When there is no suitable way to open the locks, the transportation security administration has the right to cut off the locks in order to check the bags or suitcases. Unfortunately, once the locks are cut off, the locks are not able to be used again, and the owners have to purchase new locks. Therefore, TSA locks are developed to allow the transportation security administration to unlock the locks without damage to the locks.

For combination locks, only the correction combinations can unlock the lock, the transportation security administration has no other way to unlock the combination locks except to cut off the locks, although the combination locks are deemed as safe locks.

The present invention intends to provide a TSA lock which can be unlocked by either a TSA key or the owner's key, or by setting correct combinations.

SUMMARY OF THE INVENTION

The present invention relates to a lock and comprises a casing which includes a room defined therein, and two apertures are defined through the casing and communicate with the room. A core is located within the room and has a keyhole defined in the first end thereof which is exposed from the casing. A protrusion extends from the second end of the core. A resilient member is mounted to the protrusion. A driving member has the first end thereof mounted to the protrusion of the core. The resilient member is biased between the first end of the driving member and the core. The second end of the driving member has at least one slide slot defined therein. A rotary member is located in the room and has a tubular member extending from the first end thereof. The tubular member extends through the driving member and is connected to the protrusion of the core. An engaging member extends laterally from the tubular member and is received in the at least one slide slot when the rotary member is rotated by rotating the core. The second end of the rotary member has an inclined face.

A push member is located in the room and has the first end thereof contacting the inclined face of the rotary member. The second end of the push member extends through one of the two apertures corresponding thereto. An assembling hole is defined laterally in the first end of the push member. The casing has an insertion extending from the inner wall thereof. The insertion is inserted into the assembling hole. A first spring is located in the assembling hole and biased between the insertion and the inner end of the assembling hole. The first spring pushes the push member to contact the rotary member. A reception hole is defined in the second end of the push member.

A dial unit is located in the room and located beside the core. The dial unit has a rod, at least three dial disk units and a second spring. The rod is located in the room and has a head and a shank. The head is located corresponding to the other aperture and has a positioning slot defined in the top thereof. The shank extends from the bottom of the head. The dial disk units are mounted to the shank and each have a dial disk and a sleeve which is mounted to the shank. The dial disk units are overlapped to each other. The sleeve of each dial disk unit has a tube and a disk from which the tube extends. At least two lateral parts are connected to the connection portion between the tube and the disk. The dial disks are respectively mounted to the sleeves. Each dial disk has multiple number protrusions extending therefrom. The number protrusions of each dial disk are exposed beyond the casing. Each dial disk has a mounting hole defined centrally therethrough. Multiple spaced ridges extend from the inner periphery of each mounting hole. The at least two lateral parts of each dial disk are engaged with gaps between the ridges. Each disk has a recess defined radially therein. The second spring is mounted to the shank of the rod and biased between the inner wall of the room and the disk of the sleeve that is located at the lowest position of the overlapped sleeves. A resilient plate is located in the room and has fingers resiliently engaged with notches defined between the number protrusions of the dial disks.

A pawl member is located in the room and pivotably connected between the driving member and the dial unit. The pawl member has multiple pawls which are located corresponding to the recesses of the disks. An operation member is connected to the pawl member and located beside the driving member. The operation member has a recessed area defined therein which faces the driving member. The driving member has a block which is engaged with the recessed area. When the driving member is rotated, the operation member rotates the pawl member so that the pawls are engaged with the recesses to restrict rotation of the dial disks. A third spring is biased between the operation member and the inner all of the room of the casing. A shackle has the first end inserted into the reception hole of the push member, and the second end of the shackle extends through one aperture and inserted in the positioning slot of the head of the dial unit.

When a transportation security administration key is inserted into the keyhole of the core and rotates the core clockwise, the rotary member contacts the second end of the driving member until the inclined face of the rotary member faces the push member, and the first spring in the push member pushes the push member toward the rotary member, the first end of the shackle is removed from the reception hole of the push member to unlock the lock.

When a correct key is inserted into the keyhole of the core and rotates the core counter clockwise, the rotary member is rotated counter clockwise and the engaging member is rotated to face the at least one slide slot. The driving member is pushed upward by the resilient member and contacts the rotary member to remove the block away from the recessed area. The dial disks are rotated until the pawls of the pawl member are engaged with the recesses of the sleeves to set correction combinations.

Preferably, the engaging member of the rotary member includes a first member and a second member. The first member is defined in the underside of the rotary member and perpendicular to the tubular member. The second member extends laterally from the first member. The at least one slide slot of the driving member includes a first slot and a second slot which is located at one end the first slot. The first slot is an inclined face formed on a top of the driving member. When the rotary member is rotated and the second member of the engaging member is located corresponding to the second slot, the driving member is pushed upward by the resilient member so that the driving member is matched with the rotary member.

Preferably, the tubular member of the rotary member has an auxiliary member which is located diametrically opposite to the engaging member. The driving member has two spaced slide slots defined in the second end thereof. Two heights are formed between the two slide slots and located alternatively to the two slide slots. The rotary member is rotated to respectively merge the engaging member and the auxiliary member into the two slide slots to match the rotary member with the driving member.

Preferably, the rotary member has a flat face defied in the second end thereof, and the flat face is connected to one end of the inclined face. The push member contacts the flat face when the core is not rotated. When the core is rotated clockwise, the push member is pushed by the first spring and contacts the inclined face. The first end of the shackle is disengaged from the reception hole of the shackle.

Preferably, the recessed area of the operation member includes an upright face and a base face which is perpendicular to the upright face. The block has a side face which faces the upright face. The side face contacts the upright face when the core is not rotated so as to engage the pawls with the recesses.

Preferably, the casing includes a first part and a second part which is connected to the first part to define the room and the two apertures. The casing includes multiple ridges which position the core, the driving member, the rotary member, the push member, the dial unit, the resilient plate and the pawl member in the room.

Preferably, the second end of the shackle includes a groove. A flange is formed in the positioning slot of the dial unit. The flange is engaged with the groove to secure the second end of the shackle.

Preferably, each of the sleeves includes a restriction hole defined therethrough. The restriction hole includes a first hole and a second hole which communicates with the first hole. The first hole is a circular hole and the second hole is a rectangular hole. The shank of the rod includes at least three bosses extending from the outer periphery thereof. When the at least three bosses are located corresponding to the second holes of the sleeves, the pawls are engaged with the recesses of the sleeves.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
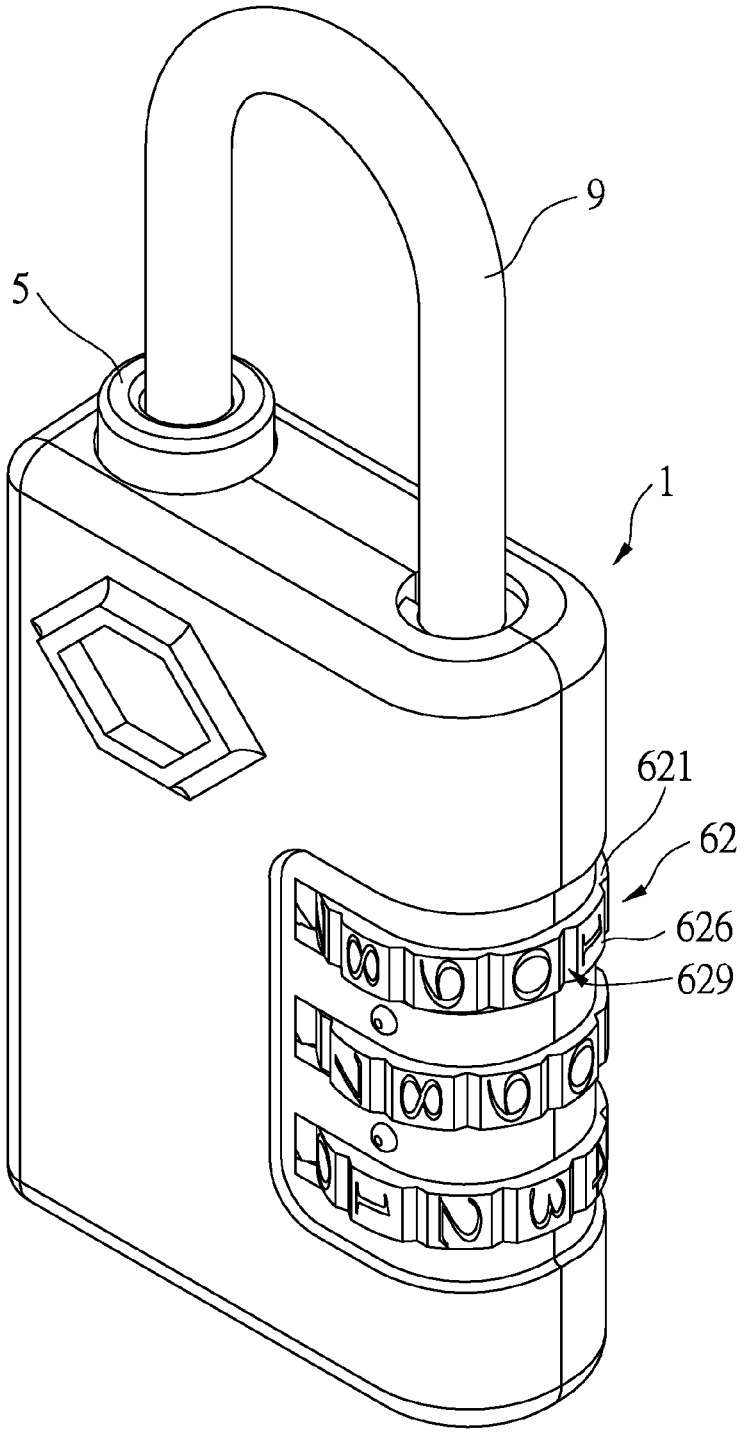
FIG. 1 is a perspective view to show the lock of the present invention.

Referring to FIGS. 1 to 10, the lock of the present invention comprises a casing 1 having a room 11 defined therein. Two apertures 12 are defined through the casing 1 and communicate with the room 11. A core 2 is located within the room 11 and has a keyhole 21 defined in the first end thereof which is exposed from the casing 1. A protrusion 22 extends from the second end of the core 2. A resilient member 32 is mounted to the protrusion 22. A driving member 3 has the first end thereof mounted to the protrusion 22 of the core 2. The resilient member 32 is biased between the first end of the driving member 3 and the core 2. The second end of the driving member 3 has at least one slide slot 31 defined therein. A rotary member 4 is located in the room 11 and has a tubular member 41 extending from the first end thereof. The tubular member 41 extends through the driving member 3 and is connected to the protrusion 22 of the core 2. An engaging member 42 extends laterally from the tubular member 41. The engaging member 42 is received in the at least one slide slot 31 when the rotary member 4 is rotated by rotating the core 2. The second end of the rotary member 4 has azo inclined face 43.

A push member 5 is located in the room 11 and has the first end thereof contacting the inclined face 43 of the rotary member 4, and the second end of the push member 5 extends through one of the two apertures 12 corresponding thereto. An assembling hole 51 is defined laterally in the first end of the push member 5. The casing 1 has an insertion 13 extending from the inner wall thereof so as to be inserted into the assembling hole 51. A first spring 14 is located in the assembling hole 51 and biased between the insertion 13 and the inner end of the assembling hole 51. The first spring 14 pushes the push member 5 to contact the rotary member 4. A reception hole 52 is defined in the second end of the push member 5.

A dial unit 6 is located in the room 11 and located beside the core 2. The dial unit 6 has a rod 61, at least three dial disk units 62 and a second spring 63. The rod 61 is located in the room 11 and has a head 611 and a shank 612. The head 611 is located corresponding to the other aperture 12 and has a positioning slot 613 defined in the top thereof. The shank 612 extends from the bottom of the head 611. The dial disk units 62 are mounted to the shank 612 and each have a dial disk 621 and a sleeve 622 which is mounted to the shank 612. The dial disk units 62 are overlapped to each other on the rod 61. The sleeve 622 of each dial disk unit 62 has a tube 623 and a disk 624 from which the tube 623 extends.

At least two lateral parts 625 are connected to the connection portion between the tube 623 and the disk 624. The dial disks 621 are respectively mounted to the sleeves 623. Each dial disk 621 has multiple number protrusions 626 extending therefrom. The number protrusions 626 of each dial disk 621 are exposed beyond the casing 1 for convenient operation to the users. Each dial disk 621 has a mounting hole 627 defined centrally therethrough. Multiple spaced ridges 628 extend from the inner periphery of each mounting hole 627. The at least two lateral parts 625 of each dial disk 621 are engaged with gaps between the ridges 628. Each disk 624 has a recess 64 defined radially therein. The second spring 63 is mounted to the shank 612 of the rod 61 and biased between the inner wall of the room 11 and the disk 624 of the sleeve 622 that is located at the lowest position of the overlapped sleeves 622.

A resilient plate 7 is located in the room 11 and has fingers resiliently engaged with notches 629 defined between the number protrusions 626 of the dial disks 621 so as to prevent the dial disks 621 from overly rotated. A pawl member 8 is located in the room 11 and pivotally connected between the driving member 3 and the dial unit 6. The pawl member 8 has multiple pawls 81 which are located corresponding to the recesses 64 of the disks 624. An operation member 82 is connected to the pawl member 8 and located beside the driving member 3. The operation member 82 has a recessed area 821 defined therein which faces the driving member 3. The driving member 3 has a block 33 which is engaged with the recessed area 821. When the driving member 3 is rotated, the operation member 82 rotates the pawl member 8 so that the pawls 81 are engaged with the recesses 64 to restrict rotation of the dial disks 621. A third spring 83 is biased between the operation member 82 and the inner wall of the room 11 of the casing 1.

A shackle 9 has the first end inserted into the reception hole 52 of the push member 5, and the second end of the shackle 9 extends through the other aperture 12 and inserted in the positioning slot 613 of the head 611 of the dial unit 6. When a transportation security administration key is inserted into the keyhole 21 of the core 2 and rotates the core 2 clockwise, the rotary member 4 contacts the second end of the driving member 3 until the inclined face 43 of the rotary member 4 faces the push member 5, and the first spring 14 in the push member 5 pushes the push member 5 toward the rotary member 4. The first end of the shackle 9 is removed from the reception hole 52 of the push member 5 to unlock the lock.

When a correct key is inserted into the keyhole 21 of the core 2 and rotates the core 2 counter clockwise, the rotary member 4 is rotated counter clockwise and the engaging member 42 is rotated to face the at least one slide slot 31. The driving member 3 is pushed upward by the resilient member 32 and contacts the rotary member 4 to remove the block 33 away from the recessed area 821. The dial disks 621 are rotated until the pawls 81 of the pawl member 8 are engaged with the recesses 64 of the sleeves 622 to set correction combinations. These numbers on the number protrusions 626 exposed from the casing 1 are the initial combination that the user set.

Figure 3:
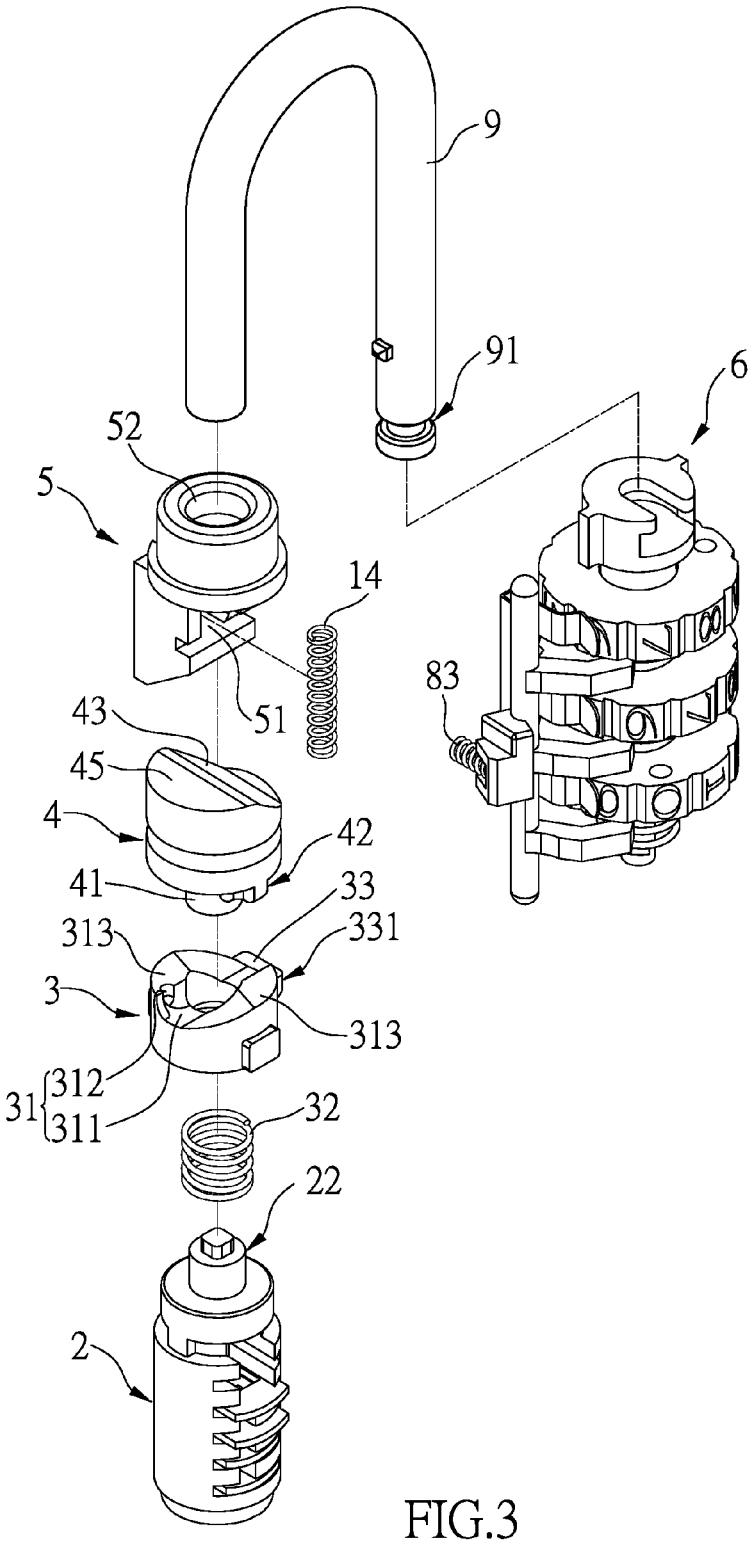
FIG. 3 is an exploded view to show the parts in the lock of the present invention.
Figure 5:
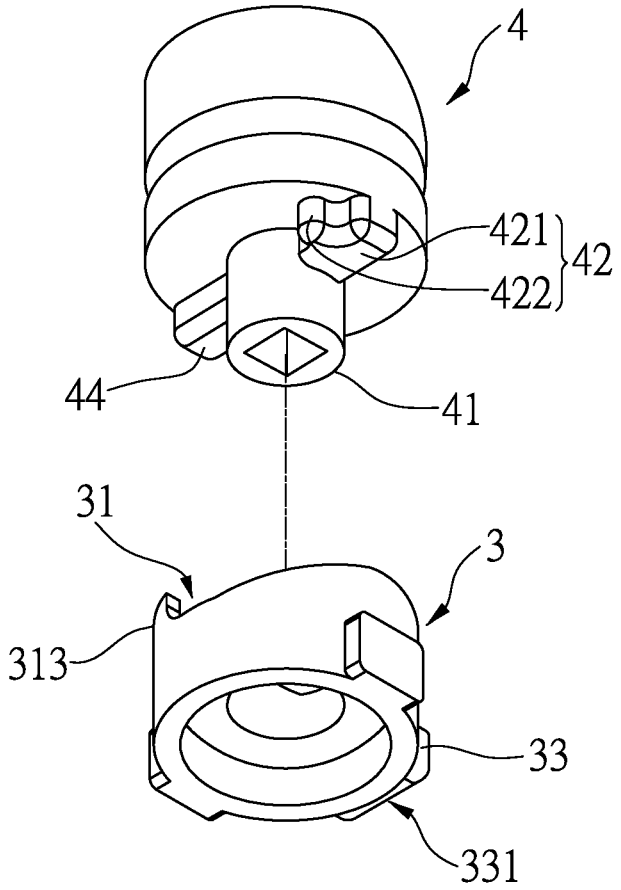
FIG. 5 is an exploded view of the driving member and the rotary member of the lock of the present invention.
Figure 6:
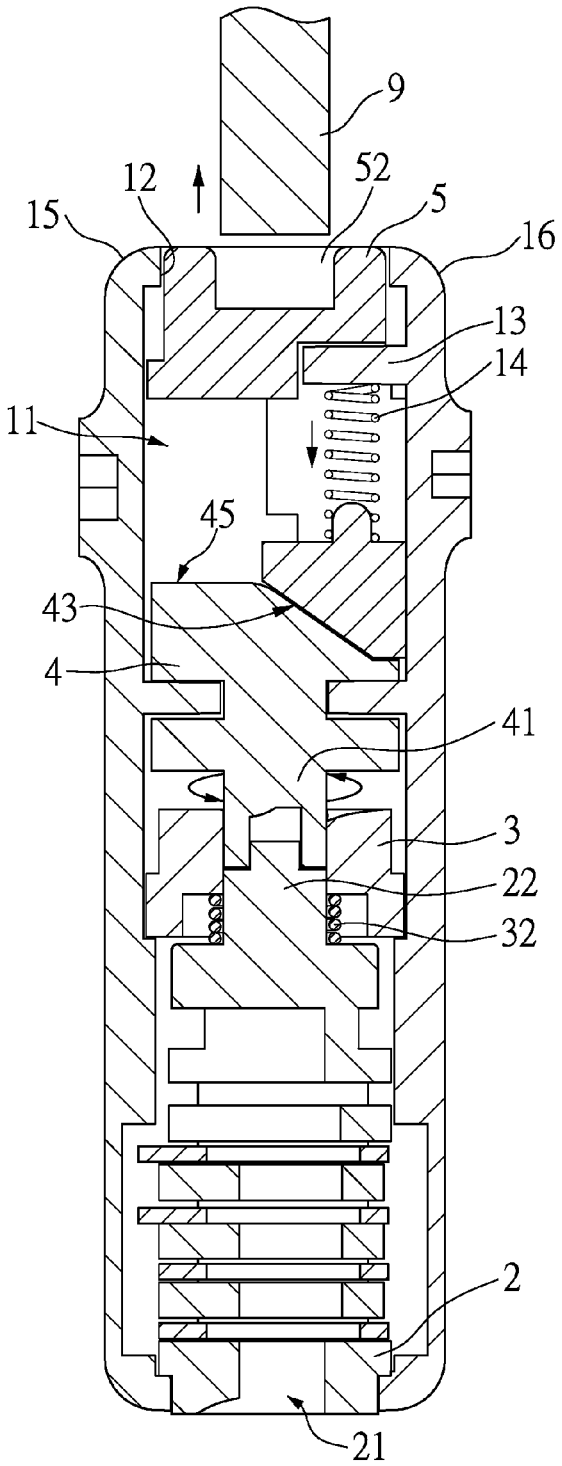
FIG. 6 is a cross sectional view to show that the core is rotated clockwise, and the shackle is disengaged from the push member.
Figure 7:
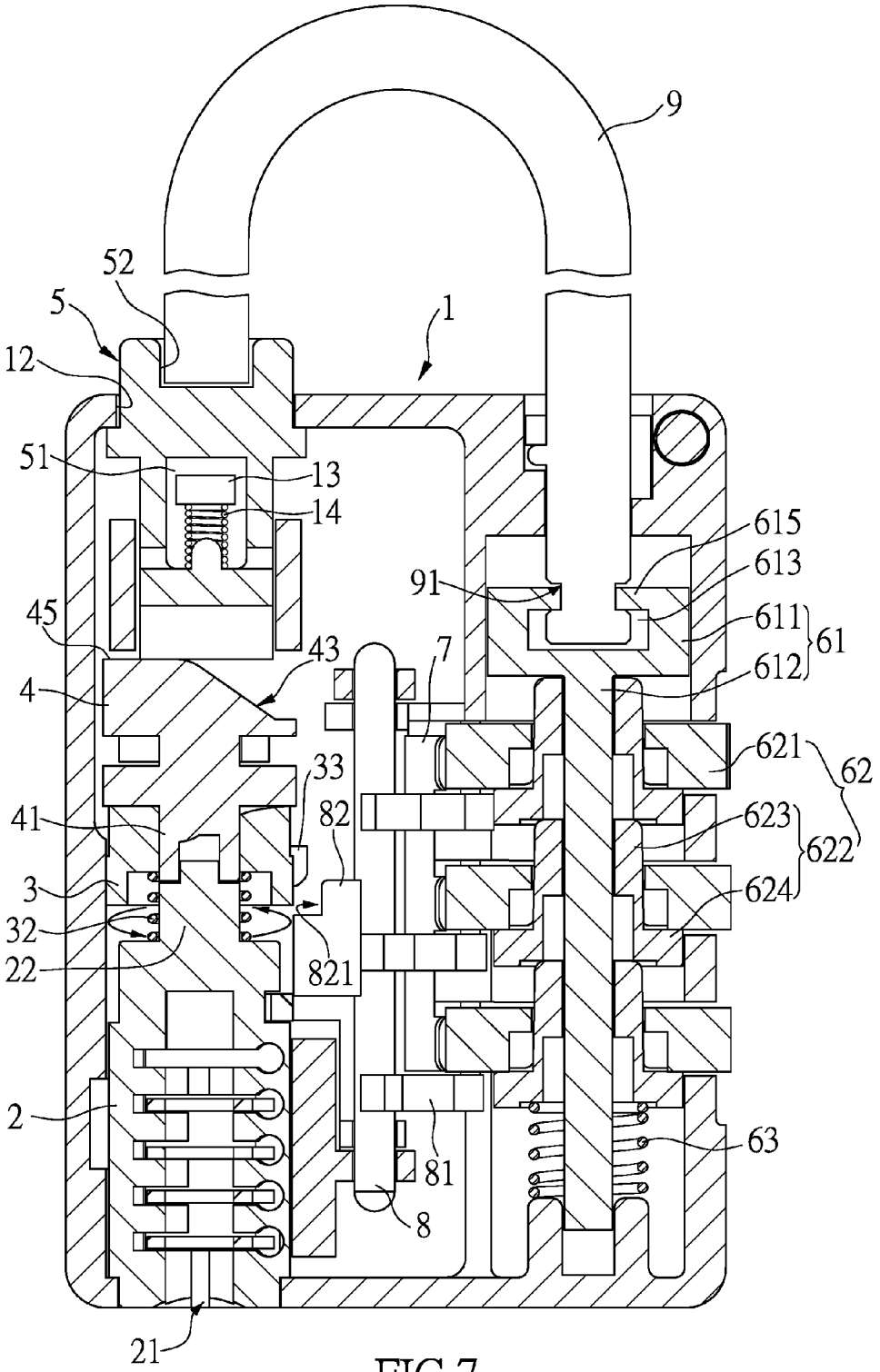
FIG. 7 is a cross sectional view to show that the core is rotated counter clockwise, and the rotary member is rotated counter clockwise.
Figure 8:
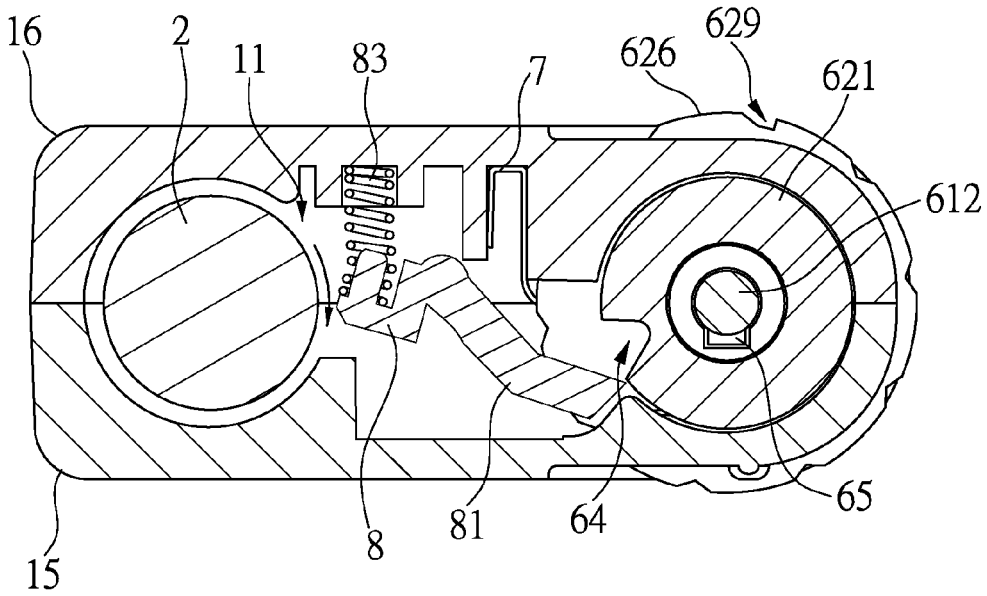
FIG. 8 is an end cross sectional view to show that the pawls are not engaged with the recesses of the sleeves.
Figure 9:
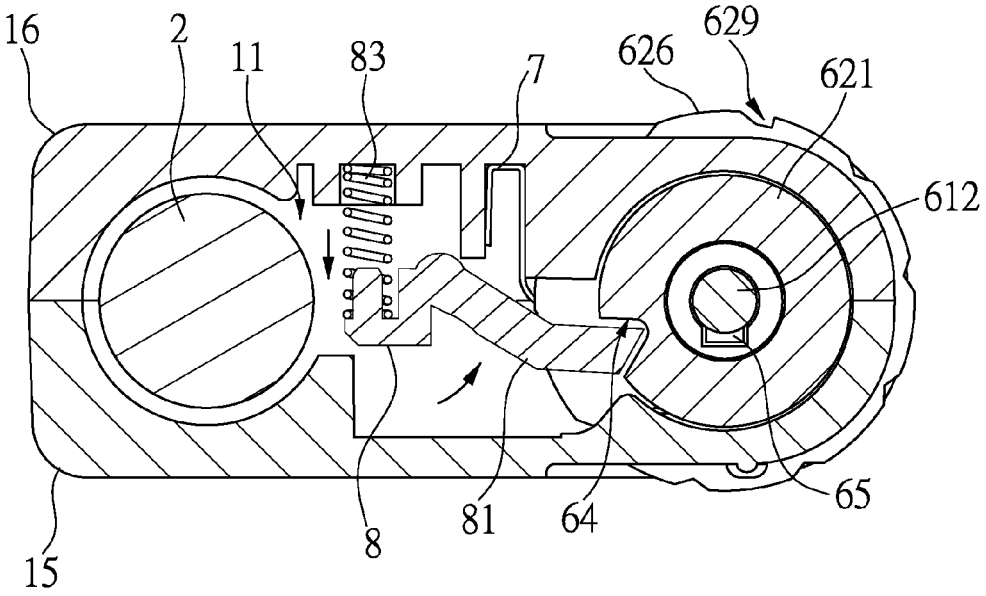
FIG. 9 is an end cross sectional view to show that the pawls are engaged with the recesses of the sleeves.
Figure 10:
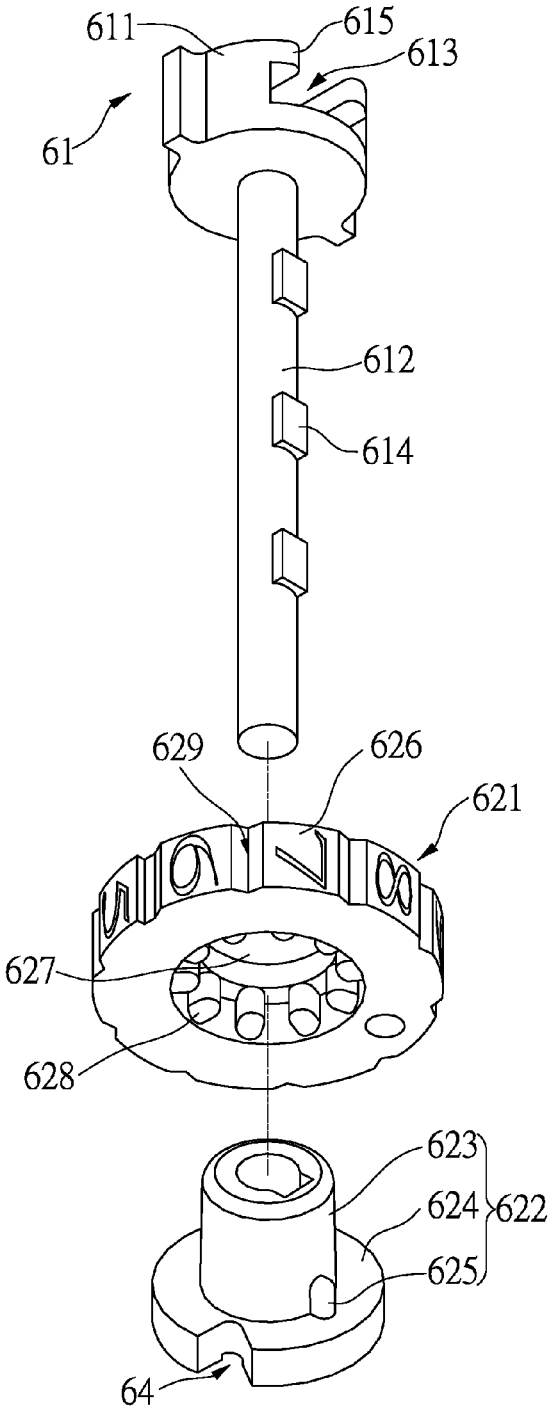
FIG. 10 is an exploded view to show the dial disk, the sleeve and the rod of the lock of the present invention.

As shown in FIGS. 3, 5 and 6, When a transportation security administration key is inserted into the keyhole 21 of the core 2 and rotates the core 2 clockwise, the rotary member 4 contacts the second end of the driving member 3 until the inclined face 43 of the rotary member 4 faces the push member 5. Because the first spring 14 is compressed when the lock is in locked status, so that when the push member 5 faces the inclined face 43, the first spring 14 pushes the push member 5 downward so that the first end of the shackle 9 is removed from the reception hole 52 of the push member 5 to unlock the lock.

As shown in FIGS. 2, 4, and 7-11, if the user forget the combination, the present invention provides a feature to find out the initial combination. The user inserts the correct key into the keyhole 21 of the core 2 and rotates the core 2 counter clockwise, the rotary member 4 is rotated counter clockwise and the engaging member 42 is rotated to face the at least one slide slot 31. The resilient member 32 is compressed when the lock is in locked status. Because the shape of the engaging member 42 is the same as that of the at least one slide slot 31, so that when the engaging member 42 is rotated to face the at least one slide slot 31, the driving member 3 is pushed upward by the resilient member 32 and contacts the rotary member 4 to remove the block 33 away from the recessed area 821. The pawl member 8 releases the dial disks units 62 so that the user can rotate the dial disks 621. The dial disks 621 are rotated until the pawls 81 of the pawl member 8 are engaged with the recesses 64 of the sleeves 622 by the third spring 83. These numbers on the number protrusions 626 exposed from the casing 1 are the initial combination that the user set.

The engaging member 42 of the rotary member 4 includes a first member 421 and a second member 422. The first member 421 is defined in the underside of the rotary member 4 and perpendicular to the tubular member 41. The second member 422 extends laterally from the first member 421. The at least one slide slot 31 of the driving member 3 includes a first slot 311 and a second slot 312 which is located at one end of the first slot 311. The first slot 311 is an inclined face formed on the top of the driving member 3. As shown in FIGS. 3 and 5, when the rotary member 4 is rotated counter clockwise and the second member 422 of the engaging member 42 is located corresponding to the second slot 312, and the first member 421 is located corresponding to the first slot 311, the driving member 3 is pushed upward by the resilient member 32 so that the pawl member 8 releases the restriction to the sleeves 622. The user is able to rotate the dial disks 621.

The tubular member 41 of the rotary member 4 has an auxiliary member 44 which is located diametrically opposite to the engaging member 42. The driving member 3 has two spaced slide slots 31 defined in the second end thereof. Two heights 313 are formed between the two slide slots 31 and located alternatively to the two slide slots 31. The rotary member 4 is rotated to respectively merge the engaging member 42 and the auxiliary member 44 into the two slide slots 31 to match the rotary member 4 with the driving member 3. Therefore, the pawl member 8 releases the restriction to the sleeves 622. The auxiliary member 44 ensures that the driving member 3 to be more securely matched to the rotary member 4 such that the dial disks 621 can be stably rotated.

Figure 2:
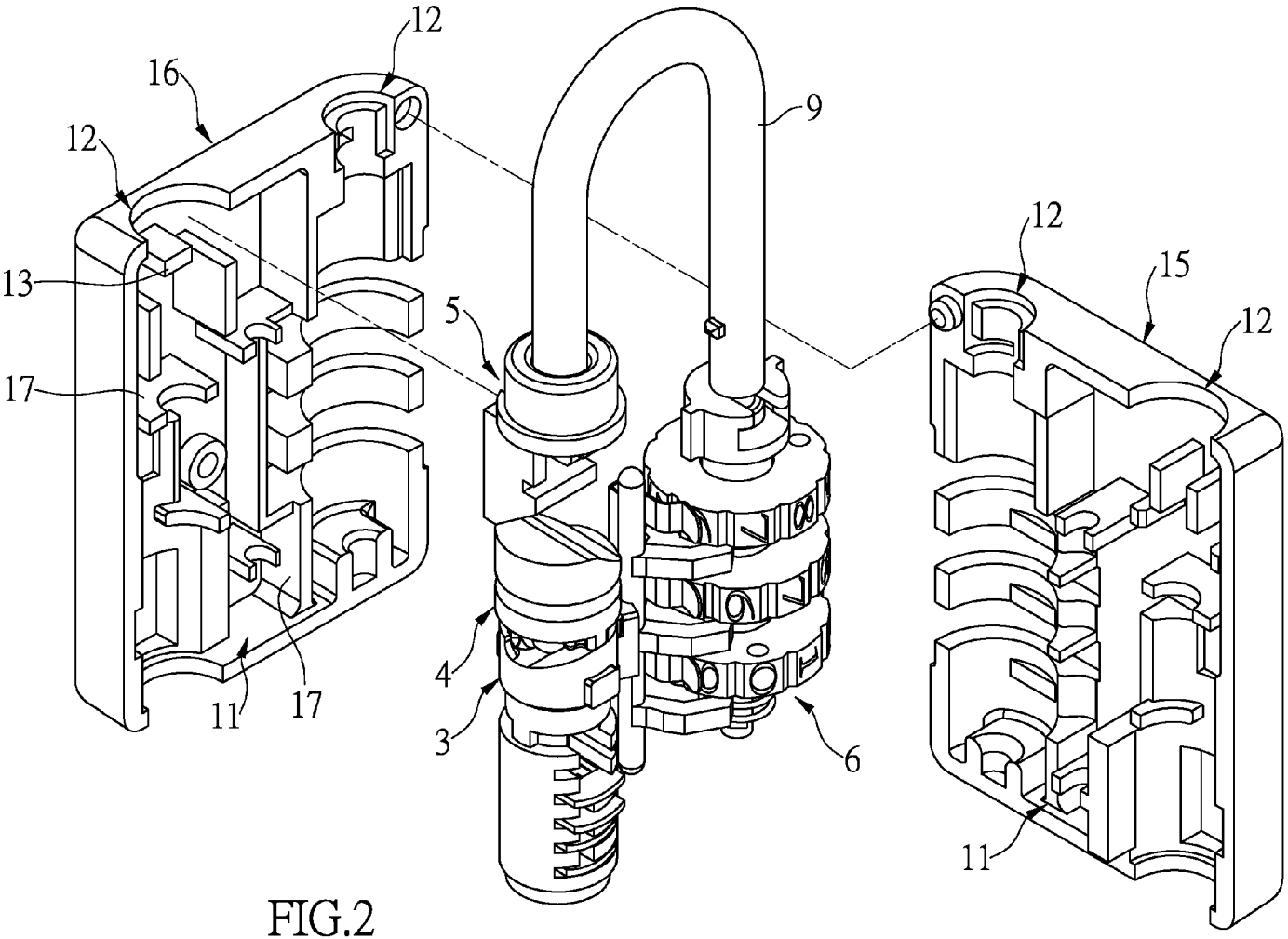
FIG. 2 is an exploded view of the casing of the lock of the present invention.

As shown in FIGS. 2 and 3, the rotary member 4 has a flat face 45 defined in the second end thereof, and the flat face 45 is connected to one end of the inclined face 43. The push member 5 contacts the flat face 45 when the core 2 is not rotated. The first end of the push member 5 is tapered toward the second end of the push member 5. When the core 2 is rotated clockwise, the push member 5 is pushed by the first spring 14, and the tapered first end of the push member 5 moves and contacts the inclined face 43. The inclined face 43 guides the push member 5 downward. The first end of the shackle 9 is disengaged from the reception hole 52 of the push member 5.

When the user wants to find out the initial combination, the user has to release the operation member 82 from the driving member 3, such that the dial disks 621 are able to be rotated. As shown in FIGS. 3, 4 and 7 to 9, the recessed area 821 of the operation member 82 includes an upright face 824 and a base face 825 which is perpendicular to the upright face 824. The block 33 has a side face 331 which faces the upright face 824. The side face 331 contacts the upright face 824 when the core 2 is not rotated so as to engage the pawls 81 with the recesses 64. When the driving member 3 is pushed upward by the resilient member 32, the block 33 is moved upward so that the side face 331 is removed from the upright face 824. Therefore, the operation member 82 is pushed upward by the third spring 83, and the pawls 81 are pivoted downward to contact the disks 624 of the sleeves 622. The user then rotates the dial disks 621 to engage the pawls 81 with the recesses 64, such that the numbers exposed from the casing 1 are the initial combination.

Figure 4:
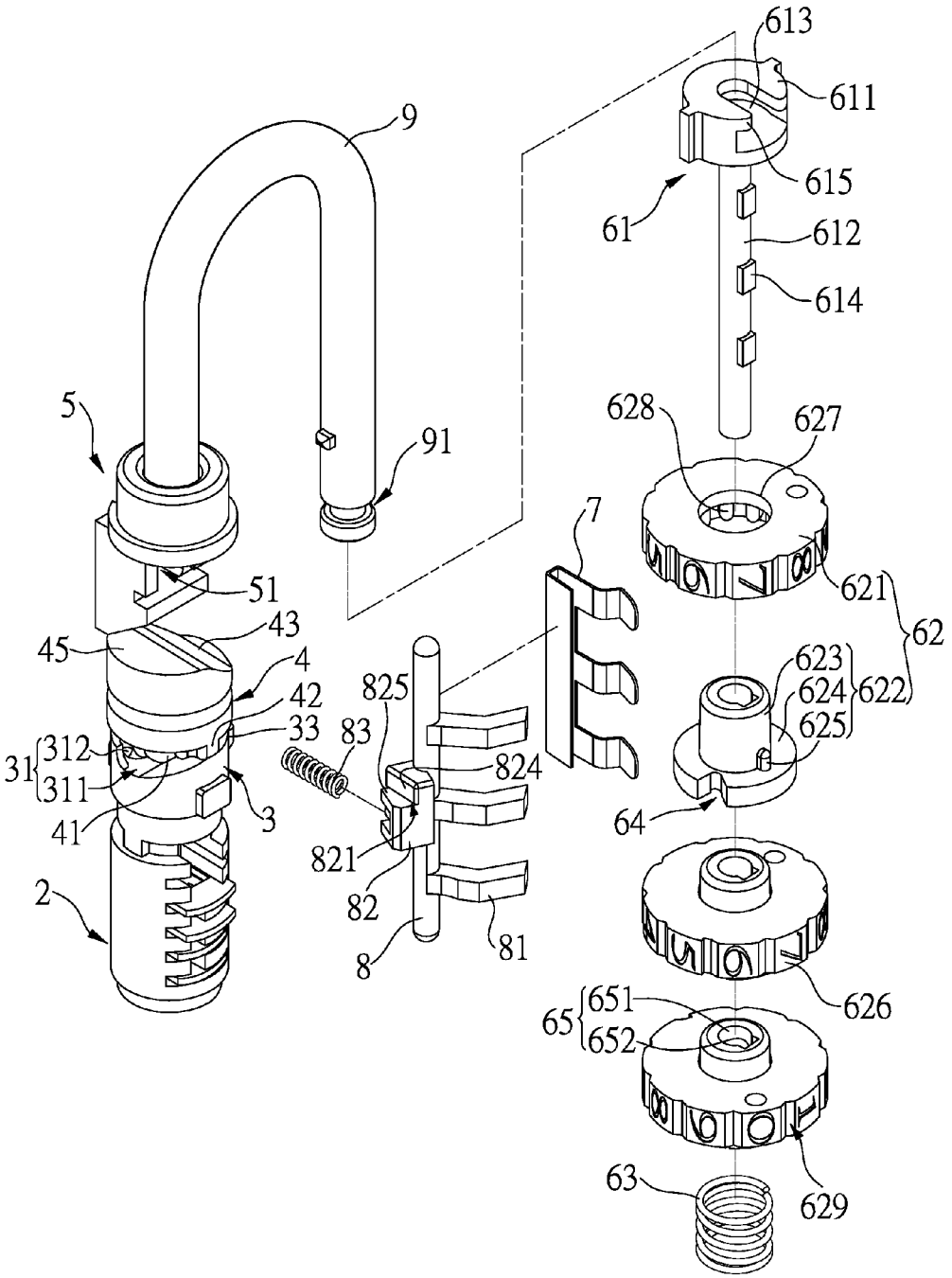
FIG. 4 is an exploded view to show the dial unit of the lock of the present invention.
Figure 11:
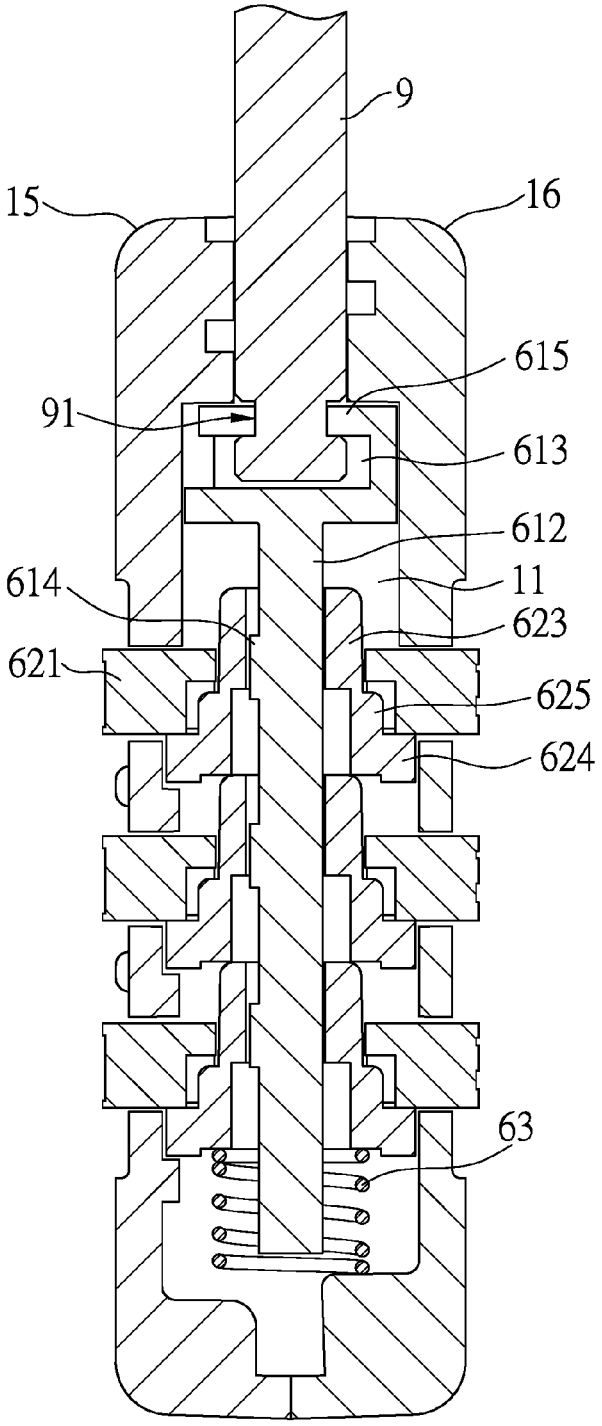
FIG. 11 is a side cross sectional view to show that the pawl member is pivoted to engage with the recesses of the sleeves after the dial disks are rotated.

Specifically, each of the sleeves 622 includes a restriction hole 65 defined therethrough. The restriction hole 65 includes a first hole 651 and a second hole 652 which communicates with the first hole 651. The first hole 651 is a circular hole and the second hole 652 is a rectangular hole. The shank 612 of the rod 61 includes at least three bosses 614 extending from the outer periphery thereof. When the at least three bosses 614 are located corresponding to the second holes 652 of the sleeves 622, the pawls 81 are engaged with the recesses 64 of the sleeves 622. The user can find out the initial combination when the lock is in locked status and the second spring 63 is in compressed status. As shown in FIGS. 11 and 4, when the numbers that are exposed from the casing 1 are correct, the second hole 652 of each sleeve 622 is matched with the boss 614 corresponding thereto. Besides, in order to prevent the shackle 9 from disengaging from the positioning slot 613 of the rod 61, the second end of the shackle 9 includes a groove 91, and a flange 615 is formed in the positioning slot 613 of the dial unit 6, so that the flange 615 is engaged with the groove 91 to secure the second end of the shackle 9.

The casing 1 includes a first part 15 and a second part 16 which is connected to the first part 15 to define the room 11 and the two apertures 12. The casing 1 includes multiple ridges 17 which position the core 2, the driving member 3, the rotary member 4, the push member 5, the dial unit 6, the resilient plate 7 and the pawl member 8 in the room 11.

While we have shown and described the embodiment in accordance with the present invention, it should be clear to those skilled in the art that further embodiments may be made without departing from the scope of the present invention.

What is claimed is:

1. A lock comprising:

a casing having a room defined therein, two apertures defined through the casing and communicating with the room;

a core located within the room and having a keyhole defined in a first end thereof which is exposed from the casing, a protrusion extending from a second end of the core, a resilient member mounted to the protrusion;

a driving member having a first end thereof mounted to the protrusion of the core, the resilient member biased between the first end of the driving member and the core, a second end of the driving member having at least one slide slot defined therein;

a rotary member located in the room and having a tubular member extending from a first end thereof, the tubular member extending through the driving member and connected to the protrusion of the core, an engaging member extending laterally from the tubular member, the engaging member being received in the at least one slide slot when the rotary member is rotated by rotating the core, a second end of the rotary member having an inclined face;

a push member located in the room and having a first end thereof contacting the inclined face of the rotary member, a second end of the push member extending through one of the two apertures corresponding thereto, an assembling hole defined laterally in the first end of the push member, the casing having an insertion extending from an inner wall thereof, the insertion inserted into the assembling hole, a first spring located in the assembling hole and biased between the insertion and an inner end of the assembling hole, the first spring pushing the push member to contact the rotary member, a reception hole defined in the second end of the push member;

a dial unit located in the room and located beside the core, the dial unit having a rod, at least three dial disk units and a second spring, the rod located in the room and having a head and a shank, the head located corresponding to the other aperture and having a positioning slot defined in a top thereof, the shank extending from a bottom of the head, the dial disk units mounted to the shank and each having a dial disk and a sleeve which is mounted to the shank, the dial disk units being overlapped to each other, the sleeve of each dial disk unit having a tube and a disk from which the tube extends, at least two lateral parts connected to a connection portion between the tube and the disk, the dial disks respectively mounted to the sleeves, each dial disk having multiple number protrusions extending therefrom, the number protrusions of each dial disk being exposed beyond the casing, each dial disk having a mounting hole defined centrally therethrough, multiple spaced ridges extending from an inner periphery of each mounting hole, the at least two lateral parts of each sleeve being engaged with gaps between the ridges, each disk having a recess defined radially therein, the second spring mounted to the shank of the rod and biased between the inner wall of the room and the disk of the sleeve that is located at the lowest position of the overlapped sleeves;

a resilient plate located in the room and having fingers resiliently engaged with notches defined between the number protrusions of the dial disks;

a pawl member located in the room and pivotably connected between the driving member and the dial unit, the pawl member having multiple pawls which are located corresponding to the recesses of the disks, an operation member connected to the pawl member and located beside the driving member, the operation member having a recessed area defined therein which faces the driving member, the driving member having a block which is engaged with the recessed area, when the driving member is rotated, the operation member rotates the pawl member so that the pawls are engaged with the recesses to restrict rotation of the dial disks, a third spring biased between the operation member and the inner wall of the room of the casing, and a shackle having a first end inserted into the reception hole of the push member, a second end of the shackle extending through the other aperture and inserted in the positioning slot of the head of the dial unit, when a transportation security administration key is inserted into the keyhole of the core and rotates the core clockwise, the rotary member contacts the second end of the driving member until the inclined face of the rotary member faces the push member, and the first spring in the push member pushes the push member toward the rotary member, the first end of the shackle is removed from the reception hole of the push member to unlock the lock, when a correct key is inserted into the keyhole of the core and rotates the core counter clockwise, the rotary member is rotated counter clockwise and the engaging member is rotated to face the at least one slide slot, the driving member is pushed upward by the resilient member and contacts the rotary member to remove the block away from the recessed area, the dial disks are rotated until the pawls of the pawl member are engaged with the recesses of the sleeves to set correction combinations.

2. The lock as claimed in claim 1, wherein the engaging member of the rotary member includes a first member and a second member, the first member is defined in an underside of the rotary member and perpendicular to the tubular member, the second member extends laterally from the first member, the at least one slide slot of the driving member includes a first slot and a second slot which is located at one end of the first slot, the first slot is an inclined face formed on a top of the driving member, when the rotary member is rotated and the second member of the engaging member is located corresponding to the second slot, the driving member is pushed upward by the resilient member so that the driving member is matched with the rotary member.

3. The lock as claimed in claim 2, wherein the tubular member of the rotary member has an auxiliary member which is located diametrically opposite to the engaging member, the driving member has two spaced slide slots defined in the second end thereof, two heights are formed between the two slide slots and located alternatively to the two slide slots, the rotary member is rotated to respectively merge the engaging member and the auxiliary member into the two slide slots to match the rotary member with the driving member.

4. The lock as claimed in claim 1, wherein the rotary member has a flat face defined in the second end thereof, the flat face is connected to one end of the inclined face, the push member contacts the flat face when the core is not rotated, when the core is rotated clockwise, the push member is pushed by the first spring and contacts the inclined face, the first end of the shackle is disengaged from the reception hole of the push member.

5. The lock as claimed in claim 4, wherein the recessed area of the operation member includes an upright face and a base face which is perpendicular to the upright face, the block has a side face which faces the upright face, the side face contacts the upright face when the core is not rotated so as to engage the pawls with the recesses.

6. The lock as claimed in claim 5, wherein the casing includes a first part and a second part which is connected to the first part to define the room and the two apertures, the casing includes multiple ridges which position the core, the driving member, the rotary member, the push member, the dial unit, the resilient plate and the pawl member in the room.

7. The lock as claimed in claim 1, wherein the second end of the shackle includes a groove, a flange is formed in the positioning slot of the dial unit, the flange is engaged with the groove to secure the second end of the shackle.

8. The lock as claimed in claim 1, wherein each of the sleeves includes a restriction hole defined therethrough, the restriction hole includes a first hole and a second hole which communicates with the first hole, the first hole is a circular hole and the second hole is a rectangular hole, the shank of the rod includes at least three bosses extending from an outer periphery thereof, when the at least three bosses are located corresponding to the second holes of the sleeves, the pawls are engaged with the recesses of the sleeves.

* * * * *